US007077400B2

(12) United States Patent
Kenney

(10) Patent No.: US 7,077,400 B2
(45) Date of Patent: Jul. 18, 2006

(54) GAME WITH ASSOCIABLE PLAYING PIECES

(75) Inventor: Tyler Kenney, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/993,111

(22) Filed: Nov. 18, 2004

(65) Prior Publication Data

US 2005/0167914 A1 Aug. 4, 2005

Related U.S. Application Data

(60) Provisional application No. 60/601,512, filed on Aug. 12, 2004, provisional application No. 60/524,320, filed on Nov. 21, 2003.

(51) Int. Cl.
*A63F 3/00* (2006.01)

(52) U.S. Cl. ..... 273/242; 273/288

(58) Field of Classification Search ..... 273/255, 273/262, 260, 288, 289, 290, 242, 261
See application file for complete search history.

(56) References Cited

U.S. PATENT DOCUMENTS

| | | | | |
|---|---|---|---|---|
| 179,483 | A | 7/1876 | Lewis | |
| 795,822 | A | 8/1905 | Darius | |
| 1,472,657 | A | 10/1923 | Lillard | |
| 1,628,412 | A | 5/1927 | Lesavoy | |
| 1,762,269 | A | 6/1930 | Harris | |
| 2,008,189 | A | 7/1935 | Rippon | |
| 2,295,452 | A | 9/1942 | Deaton | |
| 2,342,899 | A | 2/1944 | Sands, Jr. | |
| 2,572,412 | A | 10/1951 | Wharton, Jr. | |
| 2,620,192 | A | 12/1952 | Housley | |
| 3,159,403 | A | 12/1964 | Glass et al. | |
| 3,608,904 | A | 9/1971 | Margetson | |
| 3,627,324 | A | 12/1971 | Krepp | |
| 3,751,039 | A | 8/1973 | Dykoski | |
| 3,856,309 | A | 12/1974 | Helfgott | |
| 3,947,040 | A | 3/1976 | Samuels | |
| 4,083,564 | A * | 4/1978 | Matsumoto | 273/239 |
| D249,972 | S | 10/1978 | Murphy | |
| 4,128,246 | A | 12/1978 | Hicks et al. | |
| 4,192,512 | A | 3/1980 | Erickson et al. | |
| 4,225,138 | A | 9/1980 | Wolf | |
| 4,226,419 | A | 10/1980 | Wooden | |
| 4,463,129 | A | 7/1984 | Shinada et al. | |
| 4,498,674 | A | 2/1985 | Ferris et al. | |
| 4,534,567 | A | 8/1985 | Ferris et al. | |
| 4,634,129 | A | 1/1987 | Martinez | |
| 4,844,473 | A | 7/1989 | Landsberg | |
| D320,625 | S | 10/1991 | Rubins | |
| 5,211,403 | A | 5/1993 | Ostrander | |
| 5,511,793 | A | 4/1996 | Watt | |
| 5,799,943 | A * | 9/1998 | Morgan | 273/272 |
| 6,135,452 | A * | 10/2000 | Yurchey | 273/260 |

(Continued)

FOREIGN PATENT DOCUMENTS

DE 3611513 A1 10/1987

(Continued)

*Primary Examiner*—Vishu K. Mendiratta
(74) *Attorney, Agent, or Firm*—Kolisch Hartwell, et al.

(57) ABSTRACT

The present disclosure relates to rules and apparatus for playing a combat-style board game including playing pieces and more specifically where the playing pieces have indicia relating to game play. In addition, the present disclosure relates to rules and apparatus for playing a game including playing pieces that link together to form a larger playing piece.

13 Claims, 5 Drawing Sheets

U.S. PATENT DOCUMENTS

| | | | | |
|---|---|---|---|---|
| 6,659,463 | B1 | 12/2003 | Mackey | |
| 2002/0180150 | A1 | 12/2002 | Weisman | |
| 2003/0020239 | A1 | 1/2003 | Hagen et al. | |
| 2003/0047873 | A1 | 3/2003 | Brown | |
| 2003/0071414 | A1 | 4/2003 | Weisman | |
| 2003/0094759 | A1 | 5/2003 | Niedner et al. | |
| 2004/0051244 | A1* | 3/2004 | Weisman | 273/262 |
| 2004/0051245 | A1 | 3/2004 | Weisman | |
| 2004/0262840 | A1* | 12/2004 | Lee | 273/288 |
| 2005/0048866 | A1 | 3/2005 | Ellman et al. | |

FOREIGN PATENT DOCUMENTS

| | | |
|---|---|---|
| EP | 1257332 | 11/2002 |
| FR | 532758 | 2/1922 |
| FR | 2587905 | 4/1987 |
| GB | 2148724 A | 6/1985 |
| GB | 2203350 A | 10/1988 |
| GB | 2219748 | 12/1989 |
| GB | 2241649 | 9/1991 |
| WO | WO 01/58544 | 8/2001 |

* cited by examiner

GAME WITH ASSOCIABLE PLAYING PIECES

CROSS-REFERENCE TO RELATED APPLICATIONS

This application claims priority under 35 U.S.C. 119(e) to U.S. Provisional Patent Application No. 60/524,320 entitled "GAME WITH HEXAGONAL PIECES," filed Nov. 21, 2003, and U.S. Provisional Patent Application No. 60/601,512 entitled "GAME WITH HEXAGONAL PIECES," filed Aug. 12, 2004, the disclosures of which are incorporated herein by reference, in their entirety and for all purposes.

BACKGROUND

The present disclosure relates to rules and apparatus for playing a combat board game including playing pieces and, more specifically, playing pieces where a portion of the playing pieces indicates something about game play. In addition, the present disclosure relates to rules and apparatus for playing a game including playing pieces where multiple playing pieces may be coupled together to form a single, larger, playing piece.

Examples of board games including playing pieces where a portion of the playing pieces indicates something about game play include the games Warlord Battle Titans© 1988, Games Workshop Ltd., Adeptus Titanicus© 1988, Games Workshop Ltd., and Dark World© 1992, Mattel, Inc.

Examples of patents disclosing playing pieces include U.S. Pat. Nos. 1,762,269, 2,295,452, 4,083,564, 4,128,246, 4,192,512, 4,225,138, 4,498,674, 4,634,129 and U.S. Patent Application Publication Nos. 2002/0180150A1, and 2003/0071414A1, the disclosures of which are incorporated herein by reference, in their entirety and for all purposes.

SUMMARY

The present disclosure relates to methods and apparatus for playing a combat board game including playing pieces and, more specifically, playing pieces where a portion of the playing pieces indicates something about game play. In addition, the present disclosure relates to methods and apparatus for playing a game including playing pieces where multiple playing pieces may be coupled together to form a single, larger, playing piece.

The advantages of the disclosed methods and apparatus will be understood more readily after a consideration of the drawings and the Detailed Description.

DETAILED DESCRIPTION AND BEST MODE

A game may include game pieces that players may use to battle each other in an attempt to eliminate all rival game pieces, such as by reducing their strength to zero. The game may include various optional rules, thereby allowing the players to tailor the difficulty of the game to their own desire and skill level. The following disclosure provides a number of rules and game instructions that may be used to play a game. It will be appreciated that any number of the rules may be used, ignored, or altered, as desired, and that such variation is contemplated as being within the scope of the present disclosure. The following disclosure also describes a number of playing pieces that may be coupled to one another to alter game play. It will be appreciated that the playing pieces may be used in other games and with other rules than those described herein.

GAME COMPONENTS

Figure 1:
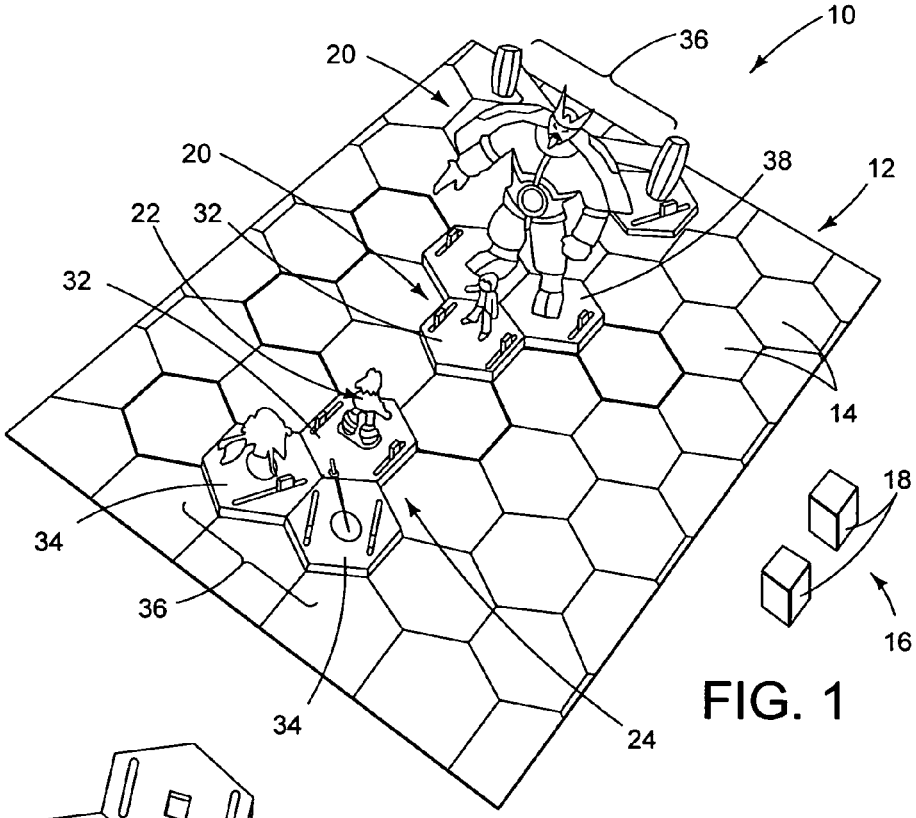
FIG. 1 is a top isometric view of an exemplary game, including a game board and playing pieces.

As shown in FIG. 1, components of a game 10 may include a game board 12 with a plurality board spaces 14. The board spaces may form a map or battlefield. According to one example of the presently described game, board spaces 14 may be hexagonal. Various types of terrain, barriers, and elements may be represented on the game board, as desired.

A random indicia generator 16, such as dice 16 may be included to generate random numbers or other indicia. While the following disclosure refers specifically to the use of dice, it will be appreciated that any suitable method of generating random numbers or other indicia, including spinners, electronic generators, and the like, may be employed and are contemplated as being within the scope of the present disclosure.

The presently described game typically includes a number of playing pieces 18 in the form of movable miniatures. Playing pieces 20 may be comprised of several components, such as a FIG. 22 and a base 24.

Base 24 may have a shape that conforms to board spaces 14 so that a particular orientation may be maintained. For example, the bases may be hexagonal in shape, having an upper surface and six sides, to match the hexagonal board spaces, as shown in FIG. 1. The shape of the board spaces and the bases of the playing pieces may also be different from one another and/or purely aesthetic.

Figure 2A:
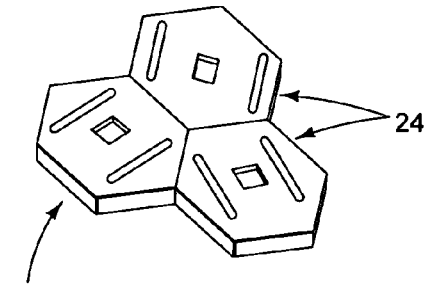
FIGS. 2A and 2B are top isometric views illustrating (A) coupling and (B) uncoupling of playing pieces.
Figure 2B:
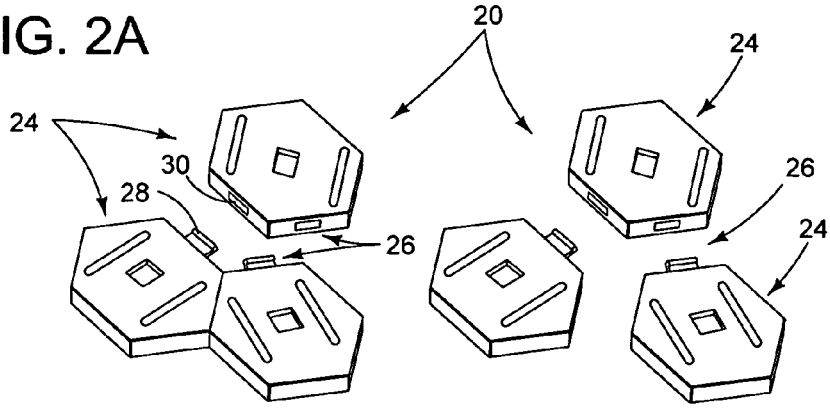

As shown in FIGS. 2–5, each base 24 may include one or more coupling mechanisms 26 that allow a base to temporarily and removably connect to the base of another playing piece. The playing pieces may join together by coupling two playing pieces together or by coupling more than two playing pieces together, as shown in FIG. 2.

Coupling mechanisms 26 may take any suitable form that allows the temporary joining of two pieces, including, but not limited to, tape, Velcro, putty, magnets, hooks, pins, and the like that provide for interlocking two or more bases 24 together. It will be appreciated that the coupling mechanisms may appear on none, some, or all of the sides of a given base.

Figure 3:
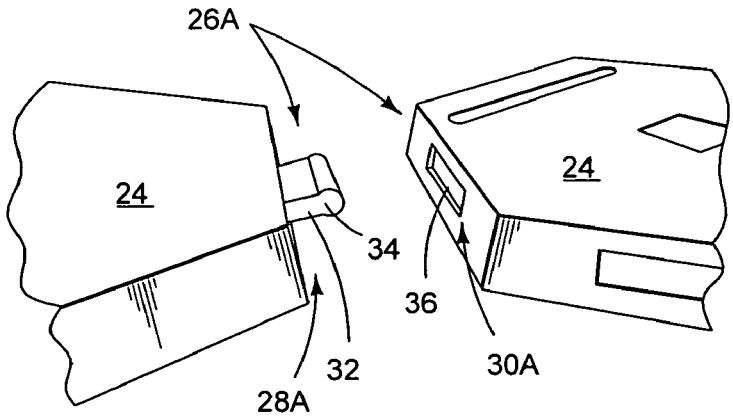
FIG. 3 is a side view of coupling of playing piece bases, showing a protrusion on one base and a socket on an opposing base.

In the example shown in FIG. 3, coupling mechanism 26A is incorporated into sides of two bases. The coupling mechanism may include one or more protrusions 28A extending from a side. The protrusions may be securely received by corresponding sockets 30A on one or more other bases. As shown, the protrusion includes a rectangular peg 32 with a rounded end 34. When inserted into slot 36, the rounded end limits relative movement between the bases.

Figure 4A:
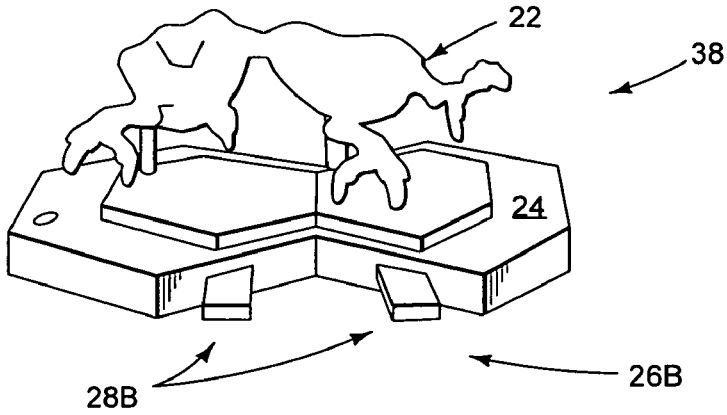
FIGS. 4A–4C are side views of playing piece bases having (A) more than one protrusion, (B) more than one socket, and (C) a single protrusion.
Figure 4B:
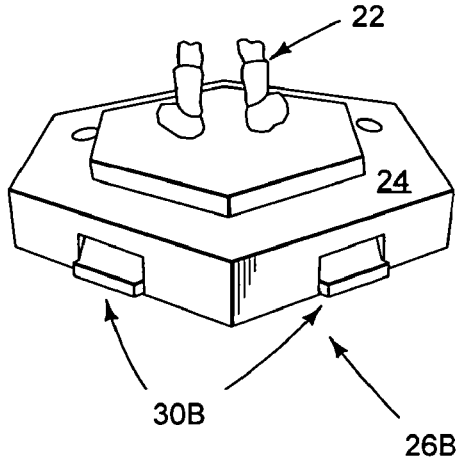
Figure 4C:
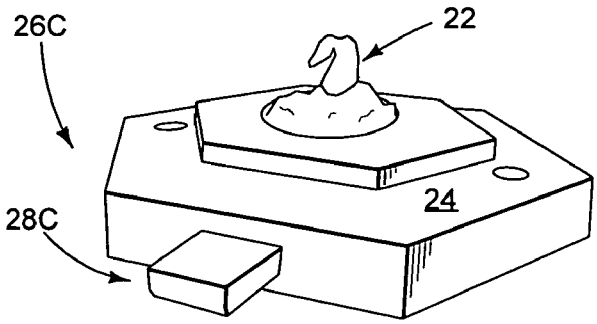

In the example shown in FIG. 4, one playing piece has a pair of protrusions 28B extending from its base (see FIG. 4A) and another playing piece has two sockets 30B in its base (see FIG. 4B) that form coupling mechanism 26B. The protrusions may be inserted into the sockets to temporarily join the pieces together. As shown in FIG. 4C, protrusion 28C need not have an enlarged end portion since coupling mechanism 26C may include magnets.

Figure 5:
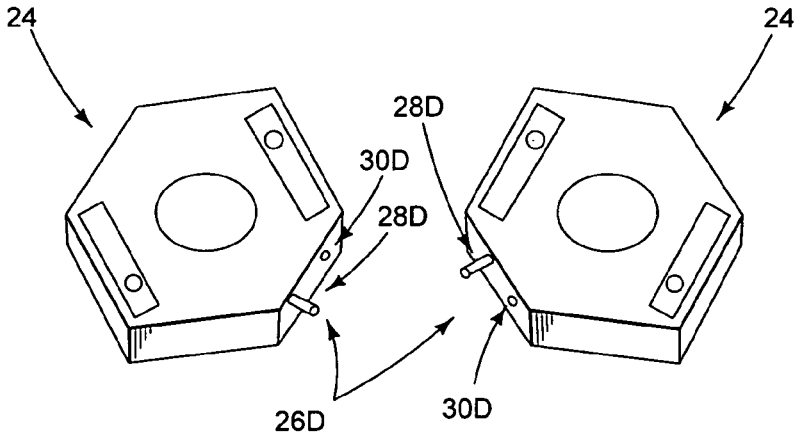
FIG. 5 is a top view of playing piece bases, each having a protrusion and a socket.

As shown in FIG. 5, a side having one or more protrusions may further include one or more sockets configured to securely receive one or more protrusions extending from another base. In the depicted example, coupling mechanism 26D includes posts 28D and holes 30D.

As previously stated, and shown in FIGS. 1 and 6, mounted to each base 24 may be a FIG. 22. The figure may assist in identifying the type of playing piece. For example, the playing pieces may include leader pieces 32 and follower pieces 34.

Figure 6A:
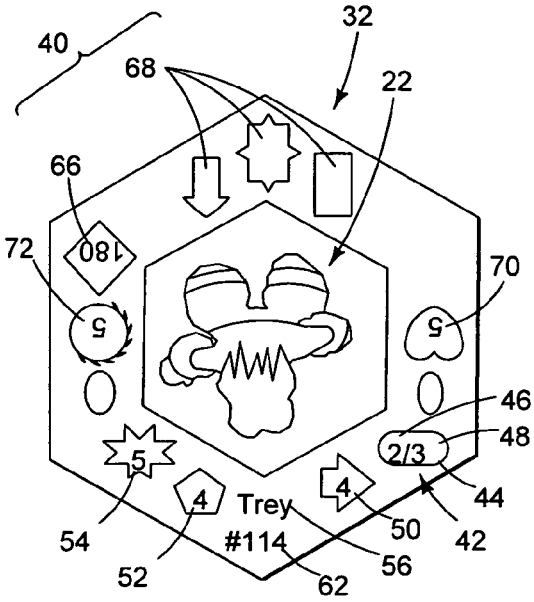
FIGS. 6A and 6B illustrate playing piece indicia (A) oriented adjacent vertices of the base and (B) oriented adjacent sides of the base.
Figure 6B:
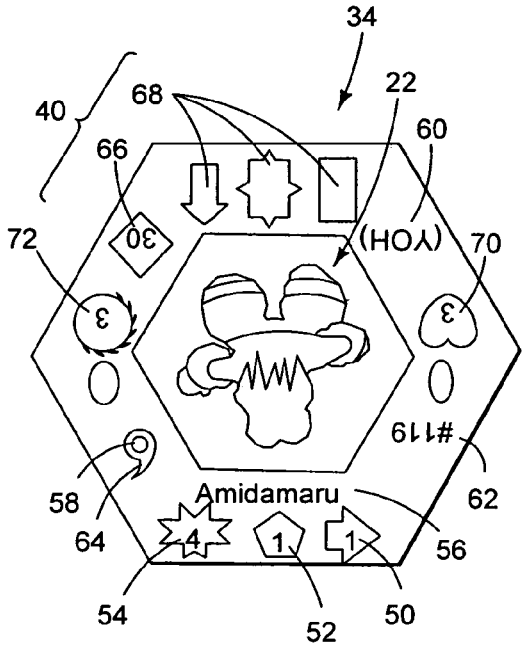

As shown by comparing FIGS. 6A and 6B, it can be seen that the leader pieces may be distinguished from the follower pieces by the orientation of the figure on the base. The leader figures may be oriented such that the figure faces towards one of the vertices of the base. Follower pieces may be oriented such that the figure faces towards a side of the base. It should be appreciated that other methods for distinguishing the leader and follower pieces may be employed, such as by size, color, shape, or any other distinguishing characteristic or indicia on either the figure or the base. Moreover, such distinction may not be required according to some methods of game play.

Referring back to FIG. 1, in one version of the game, players may increase the power of their leader pieces 32 by summoning follower pieces 34 into game play and coupling the follower pieces to the leader pieces. When two or more playing pieces are coupled together by coupling mechanisms 26, they form a unit 36 and may move as a single game piece. The unit may benefit from this formation, gaining additional powers, strength, abilities, and/or other characteristics involved in a particular game method.

In some versions of the game, a playing piece may span two bases, such as playing piece 38 shown in FIGS. 1 and 4A. This playing piece may be referred to as a megapiece 38. Megapieces may be used as leader pieces 32 or follower pieces 34 or may be substituted for coupled playing pieces 20 having a combined corresponding base size.

The depicted example follows the theme and characters of the Shaman King© by Hiroyuki Takei, which includes Shamans, Spirits, and Totems. Although these terms may be used throughout the disclosure, they are not intended to limit the disclosure to any particular representation.

Playing pieces 20 may include a plurality of indicia 40, which may be imprinted on either FIG. 22 or base 24, as shown in FIGS. 6A and 6B. The format and purpose of the indicia may vary based on the method of game play. The following indicia are intended as non-limiting examples.

As shown in FIG. 6A, some of the playing pieces may include ranged attack indicia 40 displayed on the base. A ranged attack indicia allows a playing piece 20 to attack an opposing playing piece. If the playing piece is capable of engaging in a ranged attack, this may be indicated by the presence of an oval 44 with two numbers in it. The first number 46 may represent how many dice are rolled when the playing piece shoots a ranged attack and the second number 48 may represent how far the playing piece can shoot, i.e., across how many board spaces a playing piece's ranged attack will reach.

A playing piece may further include a movement point indicia 50, as shown in FIGS. 6A and 6B. As explained in greater detail below, the movement point indicia may indicate how far, i.e., the number of board spaces, the piece may move across the board during a given turn.

A playing piece may further include a toughness indicia 52. As explained in greater detail below, the toughness indicia may indicate how hard it is to damage the playing piece.

A playing piece may further include an attack indicia 54. As explained in greater detail below, the attack indicia may indicate how many dice a player controlling that playing piece may roll during combat.

Each playing piece may further include a name indicia 56. The name indicia will typically indicate the name of the playing piece, e.g., Trey, Yoh, Amidamaru, Wooden Sword, etc.

Each playing piece may further include a summoning indicia 58. The summoning indicia may indicate the number that must be rolled to summon the playing piece into play. Playing pieces may be positioned off the board when not in play. In a game where only some of the playing pieces need to be summoned into play, those playing pieces that do not need to be summoned may not include summoning indicia 48.

Each playing piece may further include a tag indicia 60. The tag indicia may indicate with which playing piece(s) the current playing piece may be associated. For example, in a game where some or all of the follower playing pieces are associated with one or more particular leader playing pieces, the associated follower playing piece will include tag indicia identifying the leader playing piece with which the follower playing piece is associated. For example, in FIG. 6B, follower pieces Amidamaru is associated with leader piece Yoh.

Each playing piece may further include a collector indicia 62. The collector indicia may be used to help group a collection of playing pieces to begin a game, as will subsequently be described.

Each playing piece may further include a symbol indicia 64. Symbol indicia 64 may indicate the type of the playing piece, i.e., a leader 32 or follower 34. For example, as shown in FIG. 6B, the presence of a water drop may indicate that the playing piece is a Spirit follower piece.

Each playing piece may further include a point cost indicia 66. As explained in greater detail below, the point cost indicia may indicate the cost of that particular playing piece that a player must pay to add the playing piece to the player's team.

Each playing piece may further include a special ability indicia 68. The special ability indicia may indicate the special skills the playing piece has, if any. These indicia will be described in detail below Strength indicia 70 may indicate the amount of damage a figure can take before it is eliminated. For example, a heart symbol, as shown in FIGS. 6A and 6B may be used to indicate an initial strength value. When a playing piece is out of strength, it may be removed from the board and placed in a discard area. Playing pieces in the discard area may remain out of the game unless a special ability 68 brings them back.

An energy, or battle, point indicia 72 may be used in more advanced versions of the game. Energy point indicia may indicate the number of energy points the playing piece has available for use during a particular event, such as a battle. The playing piece may use the energy points to pay for certain abilities during the game. Energy points typically are not replenished during the game, so the players generally need to be strategic in determining when to use them. Pint indicia 72 may be in the form of a value in an energy ball symbol, and may be used to indicate an initial energy point value, as shown in FIGS. 6A and 6B.

Figure 7A:
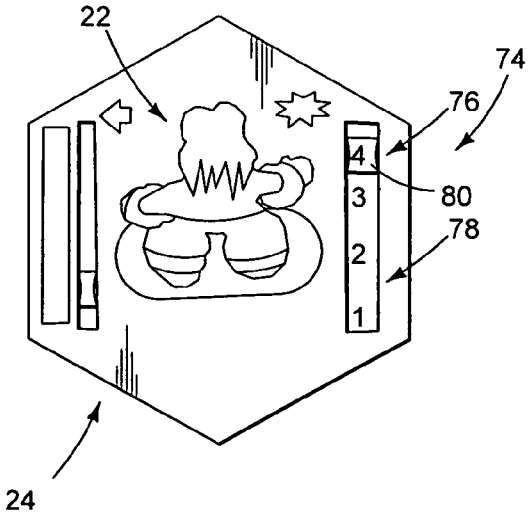
FIGS. 7A–7C are top views of playing piece bases having dynamic indicia that (A) are slidingly adjustable, (B) are rotatingly adjustable, and (C) are digitally adjustable.
Figure 7B:
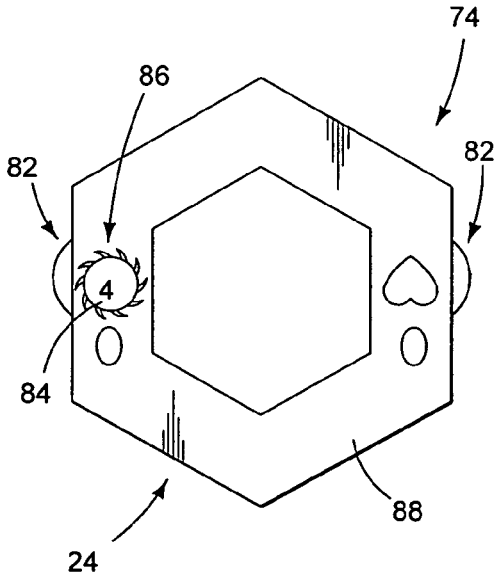
Figure 7C:
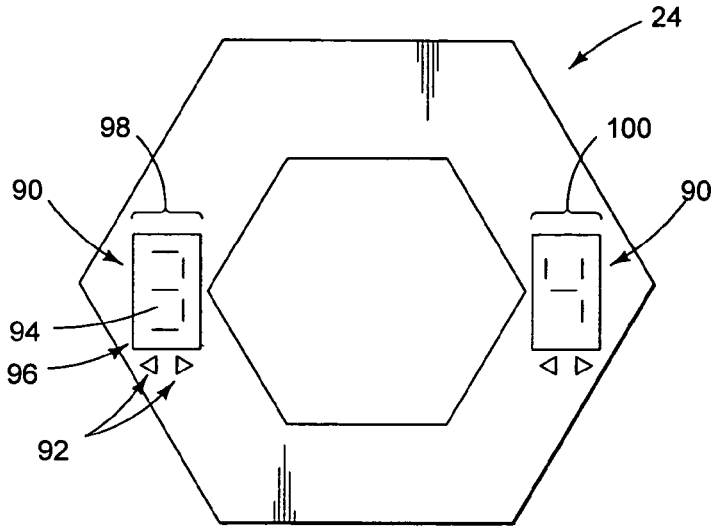

As shown in FIGS. 7A–7C, a playing piece may further include one or more indicators 74 that allow the playing piece to display dynamic indicia. For example, an indicator 74 may include a slide 76, as shown in FIG. 7A. Slide 76 is configured to translate along a list of indicia, or scale, 78 to point to, encircle, or otherwise indicate a particular indicia 80. A rotatable indicia-bearing wheel 82, as shown in FIG. 7B, may be configured to display a selected indicia 84 in a window 86 on an upper surface 88 of the base 24 of a playing piece 20 as the wheel bearing indicia is rotated beneath the window. Electronic display 90 may include buttons 92, or other control mechanisms, to assist a user in adjusting, sequencing through, or otherwise selecting an indicia 94 shown in a display 96, as shown in FIG. 7C.

As previously described, when two or more playing pieces are coupled together, their characteristics may be changed, such as by being combined. This may be accomplished physically, such as by adjusting indicators 74, marking the changed characteristics on a scorecard, or by a player mentally tracking the changed characteristics. In some forms of the game, the characteristics may be automatically changed when the playing pieces are coupled together. For example, coupling of two or more game pieces may trigger a gear system to adjust indicator 74 automatically, such as by rotating wheel 82 a predetermined number of positions. As another example, the characteristics may be changed electronically such as through radio frequency identification tagging and other methods known in the art.

According to one example of the game, a first dynamic indicia indicator 74 may be configured to display strength indicia 70, and as such may be referred to as a strength meter 98. A second dynamic indicia indicator 74 may be configured to display energy, or battle, point indicia 72. As such, the second dynamic indicia indicator may be referred to as an energy point meter 100.

According to some methods of playing the game, playing pieces may include both a strength meter and an energy meter. When attached to a leader piece, all of the follower pieces' characteristics, such as attack, toughness, and movement, may be added to the leader piece's characteristics. Additionally, these figures may absorb damage for the leader piece, i.e., any damage dealt to the leader piece may be transferred to an attached follower piece.

If a follower piece's strength meter is reduced to zero, the follower piece may be considered to be defeated and may be removed from the board. Consequently, the leader piece to which the follower piece was coupled may lose any other characteristics shared with the removed figure. If a leader piece's strength is reduced to zero, the leader piece may be considered to be defeated and it, and any coupled follower pieces, may be removed from the board.

In some versions of the game, the energy points of a coupled follower piece are added to the leader's points. The leader piece may then spend them as if they were its own and may also use any special abilities provided by the follower pieces.

Method of Game Play

The game may be played using a starter set including a given number of leader and follower playing pieces. Alternatively, players may collect additional playing pieces, through purchase, trade, or other means, and use their collected playing pieces to build unique teams. Teams may be constructed according to agreed upon rules. One exemplary rule set for team construction may include the basic steps described below. It will be appreciated that some, none, or all of these steps may be used and that additional rules and modifications to the rules below may be incorporated into the game.

First, the players agree on a point level for the game. The agreed upon point level may depend on the desired length of the game or other factors. According to one example of the game, for a standard thirty to forty minute game, each team's total point cost should not exceed 800 points.

Second, once the point level is agreed upon, each player may select the leader and follower pieces he or she wants to use. Each player may select leader pieces from his or her own collection, or the pieces may be selected from a pool of available pieces. The total point cost of the figures chosen for a team should not exceed the agreed upon total point level. According to one method of playing the game, each player must have at least one leader piece on his or her team. Follower pieces may sometimes only be used in the game when joined to a leader piece. Accordingly, the leader and follower figures may include a coupling mechanism, similar to that previously described, that allows two or more of the playing pieces to act and move as a single playing piece.

Third, each player may have only one of a particular leader piece on his or her team. Two different versions of the same leader piece may not be on the same team. Moreover, a player may not have more than one follower piece with the same collector number on his or her team. However, unlike leader pieces, a player may have different versions of a follower piece on the same team. In spite of this, a player may not have more than one follower piece with the same name on the board at the same time. In the illustrated game, leader pieces may have the names Yoh, Rio, Len, Jun, Silva, and Faust, and follower pieces may have the names Amidamaru, Len, Wooden Sword, Bason, and Talisman. There may be more than one type of follower pieces, such as Spirits and Totems.

For example, when selecting playing pieces for his team, a player may play with either the basic Yoh (collector number 101) or the advanced Yoh (collector number 110) leader piece on his team, but not with both. However, if a player has decided to use the Amidamaru spirit ball piece (collector number 119) on his team, he can also have the regular Amidamaru spirit piece (collector number 130) on his team. But, he cannot have two regular Amidamaru spirit pieces (both with collector number 130) on his team. Additionally, even if he has two different Amidamaru pieces on his team, he can only have one in play on the board at any one time.

To begin game play, the players place the game board between them on a playing surface. Each player controls a set of random number generators 16, such as dice 18. Players then select the game pieces that will make up their teams.

In a version of the game where players are playing with only a preconstructed or predefined starter set of game pieces, the players decide which team they want to play. For example, a starter set for the present game may be provided offering two teams. Team one may include two leader pieces, or Shamans: Yoh and Rio, and two follower pieces, or Spirit/Totems: Amidamaru and Wooden Sword. Team two may include two Shamans: Len and Jun, and two Spirit/Totems: Bason and Talisman. Alternatively, as described above, players may construct their own teams.

Each playing piece may have starting values printed in the symbols beside their strength and energy meters. The meters on all playing pieces may be initially set to the printed values. In some methods of playing the game, the players may agree to other starting values or may use a random number generator to determine the starting values.

Each player rolls a die. In the event of a tie, players may re-roll. The player who rolls the highest number chooses one of the board edges and sets up any leader pieces on his team within two board spaces of the edge. Half spaces along the edge of the board may not count. When the first player finishes setting up his or her leader pieces, the other player sets his or her leader pieces within two board spaces of the opposite board edge. All follower pieces may remain off the board until they are summoned into the game. Each player may line unplayed pieces up in front of him or her self, thereby creating a summoning area. The area to the right of each player's summoning area may be deemed the discard area. Playing pieces removed from the game are placed in the discard area and typically remain out of the game unless a special ability allows them to return.

Battles may be played out in a series of turns. Each turn may begin with a strategy phase in which the players determine which player goes first. For example, each player rolls a die and the player who rolls the highest value chooses whether to be the attacker or the defender for that turn. In the event of a tie, the players may re-roll.

An attacker's action phase then commences. In this phase the attacker throws a summoning roll and moves or makes a ranged attack with each playing piece he or she controls. At the start of the attacker's action phase, the attacker may throw a summoning roll to try to bring a follower piece into the game.

In the defender's action phase, the defender throws a summoning roll and moves or makes a ranged attack with each playing piece he or she controls.

During the combat phase, the attacker attacks one enemy in base contact with one of the attacker's playing pieces, the defender attacks one enemy in base contact with one of the defender's playing pieces, and the attacks are repeated in turn until all the figures that are able to attack have attacked.

To play a complete game, the strategy phase, action phases, and combat phase may be repeated in sequence until the game ends, i.e., until all of the playing pieces controlled by one of the players have been removed from the game board.

According to one method of playing the game, players may only summon follower pieces that match, i.e., bear the tag indicia for, the leader pieces they currently have in play. As previously described, the leader tag 60 indicates which follower pieces are associated with each leader piece. All pieces that have the same leader piece's name on them are associated with one another. Follower pieces without leader piece tags may be used with any leader piece. For example, in a starter set including leader pieces named Yoh, Len, Rio, and Jun and also including follower pieces called Amidamaru, Bason, Wooden Sword, and Talismans, the pieces may be configured such that Yoh and Amidamaru go together, Len and Bason go together, Rio and Wooden Sword go together and Jun and Talismans go together. Thus, the Amidamaru piece should include a Yoh leader tag, the Bason piece should include a Len leader tag, the Wooden Sword piece should include a Rio leader tag, and the Talismans piece should include a Jun leader tag.

In order to summon a follower piece into the game, a player makes a summoning roll by rolling three dice. If the total of the three dice is equal to or greater than the summoning number on a follower piece, the rolling player may bring that playing piece into play and attach it to the corresponding leader piece, such as at the back side of the base.

Each player may only get one summoning roll per turn and typically may only summon one playing piece per turn. If a single roll is greater than the summoning number on several of that player's follower pieces, a player may only bring one of the pieces in to the game that turn.

According to one method of playing the game, a single leader piece may only have one of each type of follower piece coupled at the same time. For example, a leader piece may not have two Spirits or two Totems coupled at the same time. As previously described, when a follower piece is summoned into play, it may be coupled to the leader piece, such as by sliding protrusion 28 into socket 30 until the pieces snap into place.

According to one method of playing the game, a follower piece may be summoned into an empty space. If the leader piece is positioned against either the edge of the board or against other playing pieces so that the sockets on its back are not beside an empty space, the leader piece may be turned so that a socket becomes available. If the player is unable to rotate a slot next to an empty space, the summon fails.

The term "pod" may refer to a leader piece by itself or a leader piece with one or more coupled follower pieces. The characteristics of a pod may be the combined characteristics of all the playing pieces that make up the pod. The pod may also share any special abilities had by any individual pod member. For example, a pod that is made up of a Yoh leader piece having an attack value of four, a toughness value of four, a movement value of four, a strength value of five, and an energy value of five, and an Amidamaru spirit follower piece having an attack value of four, a toughness value of one, a movement value of one, a strength value of three, and an energy value of three will have combined characteristics of an attack value of eight, a toughness value of five, a movement value of five, a strength value of eight, and an energy value of eight. If another follower piece is also attached to the pod, the characteristics may increase further.

As stated above, according to one method of playing the game, playing pieces may be required to have matching tag indicia in order to be used together, i.e., in order to create a pod. However, according to an alternate method of playing the game, players may be allowed to summon follower pieces that are not related to their leader piece, i.e., that have a different tag indicia. According to this method, a player may summon an unrelated follower piece, but will receive a penalty for doing so. The penalty may be, for example, that the unrelated follower piece enters the game with its strength and energy meters set at one.

If a coupled follower piece is destroyed and removed to the discard area, beginning with the next action phase, a player may attempt to summon a replacement piece (if he or she has one) for the empty slot. It may also be possible to replace a coupled follower piece before its strength reaches zero. When a player rolls a summon during his or her action phase, he or she may remove the coupled piece, place it in a discard area, and then replace it with a new piece. Once in the discard area, the piece is considered out of the game.

As previously discussed with respect to FIG. 4A, some of the playing pieces 38 may stand on two bases instead of one. Typically, these double base pieces will have one large summoning number 58. A double base piece may be summoned in the manner described above for single base pieces. Since the summoning number may be high, it may be more difficult to summon a double base piece than a single base piece. If a player has both types of follower pieces coupled to his or her leader piece and the follower pieces both have the same tag indicia as the double base piece, the player may trade the coupled follower pieces for the double base piece for free. The follower pieces may be removed to the discard area, as described above with respect to single base piece trades. Typically, the player may only perform the trade during the summon roll of his or her action phase and the trade counts as a summon for that turn.

According to still another method of playing the game, a double base piece may be attached to an unrelated leader piece. As described above, however, the introduction of an unrelated piece may be subject to a penalty. For example, the strength and energy characteristics for the double base piece may each be reduced to a predetermined value or by a predetermined amount.

After the summon attempt, each pod may take one action. For its action a pod may either move or shoot. Actions are not required, so a pod may take no action, if desired.

A player may move some or all of his or her pods during a turn. The number of movement points 50 listed on a leader piece may indicate the maximum number of board spaces that piece may move. As explained above, this value may be increased when a follower piece is coupled to the leader piece. A pod may move in any direction, regardless of which way it was facing, and may end its move facing any board space side. If the movement points required to move into or across a particular board space are greater than one, the required movement points may be marked on the particular board space. The number of spaces a pod has moved may be counted with respect to the leader piece. A pod may move in any direction, regardless of which direction the playing pieces are facing.

In some methods of game play, a player may move through his or her own playing pieces, but may not move through an opponent's pieces. A player may not end a move by placing a playing piece on an occupied board space.

Figure 8:
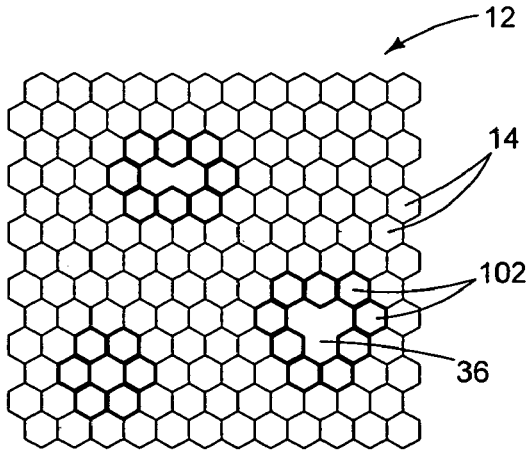
FIG. 8 depicts strike zones that surround exemplary game pieces on a playing field.

Depending on the method of play, if a leader piece moves into an enemy strike zone 102, see FIG. 8, it must stop moving. Strike zones are made up of all the spaces around a pod. A player may move his or her pod out of a board space in an enemy strike zone on the turn after entering it, but must stop again if the pod enters any other enemy's strike zone. In an advanced version of the game, a player may be penalized, such as by spending at least one energy point, when moving out of a strike zone.

Instead of moving, a pod with a ranged attack value may shoot. Sometimes, a coupled follower piece will give the corresponding leader piece this ability. As previously discussed, the ability to launch a ranged attack may be indicated by the presence of an oval 44 with two numbers in it. The first number in the oval tells the player how many dice to roll to hit with a shooting attack. The second number tells the player how far the playing piece may shoot. If the ranged attack on a playing piece only lists the second number, a ranged attack may not be launched by that playing piece alone. Therefore, another attacking playing piece that provides a first number must be a member of the same pod in order to launch a ranged attack.

Before shooting, the player may check for range before deciding which enemy to shoot. In order to check range, a player counts the number of board spaces between any playing piece in his or her attacking pod and any playing piece in the targeted opposing pod, including the board space that the targeted piece occupies. If this number is greater than the range of the attacking pod, the player may not shoot at the targeted opposing pod.

Other playing pieces between the attacking pod and an attacked pod may not block or otherwise interfere with ranged attacks. Therefore, when determining range, the board spaces are counted as if any intermediate playing pieces did not exist. However, in some versions of the game, if an attacking pod is in base contact with an enemy pod, the attacking pod may not make a ranged attack.

Once a targeted pod is determined to be in range, the player engages in a shooting roll. The player rolls a number of dice equal to the first number in the ranged attack indicia 54. For a ranged attack, each roll of a predetermined value scores a hit.

According to some methods of play, each roll of a predetermined value may score a "glancing blow." For each glancing blow scored, a player may spend at least one energy point to convert the roll to a hit. If the player does not spend the required energy points, or does not have energy points to spend, the original roll remains and no damage is sustained by the opposing playing piece.

For each hit scored, the player rolls another die. For each roll that is equal to or greater than the target's toughness 52, the target playing piece or pod loses strength, such as by one. The strength meter on the target piece's base is then moved to reduce the strength value to the next lower number for each point of damage. Sometimes a roll of a particular value, such as six, always does damage, regardless of the target piece's toughness.

For example, a player controlling a Silva leader piece, and having three shots and a range of two, may decide to attack a Faust leader piece having a toughness of three and a strength of six. After checking the range, the attacking player shoots at the Faust piece by rolling three dice, one for each shot. The attacking player rolls a one, four, and five. The one counts as a glancing blow so the attacking player spends an energy point to change it to a six, producing two hits total, one hit for the original roll of five and one for the glancing blow (original roll of one) that was converted into a six. The attacking player then rolls two dice during his damage roll (one die for each hit). This time he rolls a two and a one. The one is a critical hit, so the attacking player spends two energy points to convert the one to a six. The Faust piece's strength is three, so only the six scores a hit. Faust loses one point of strength and is now down to a strength value of five. If an attacked leader piece is coupled to a follower piece; the damage may be distributed between any of the pieces in the pod.

Once the attacker is finished, the defender takes an action phase. The rules for the defender's action phase may be identical to those of the attacker's.

After both player's action phases are complete, the players engage in the combat phase. In the combat phase, the attacker goes first, choosing to attack one enemy pod in base contact with one of his or her pods. If not in base contact with any enemies, the attacker may not make an attack during this phase. The defender goes next, attacking an enemy pod in base contact with one of his pods. Play continues to alternate until all of the leader pieces have had a chance to attack.

Once a pod attacks, it may not make another attack during that turn. Players may choose to mark each pod with a penny, token, or with other suitable means in order to indicate that a pod has made an attack during that turn.

Each combat is resolved in two rolls, similar to the ranged attacks described above. The first "combat" roll determines whether, and how many, hits are made. The second "damage" roll determines if the hits cause any damage.

To make a combat roll, the player totals up the number of attacks listed on all the playing pieces that make up the attacking pod and rolls that many dice. During the combat roll, each roll of a predetermined value, such as four or greater, scores a hit.

Similar to the ranged attack described above, a roll of one may be considered a glancing blow. A player may spend one energy point to convert the glancing blow to a six, making it a hit. If the player chooses not to spend the point, or does not have it to spend, the roll of one remains a miss.

For each hit scored, the attacking player rolls a damage die. For every roll greater than or equal to the target's toughness, as determined by the combination of the toughness values for all the pieces in the pod, the target loses one point of strength.

According to yet another method of playing the game, each one rolled scores a critical hit. For each critical hit a player rolls, the attacking pod has the option to spend energy points to convert the critical hit into a six. If the player chooses not to spend the points, or does not have them to spend, the roll of one remains a miss.

Players typically must immediately apply damage to their pods. If a leader piece has follower pieces attached to it, the player controlling the leader piece may choose to distribute the damage to any or all of the pieces in the pod. When any playing piece is reduced to zero strength, it is immediately removed to the discard area. If a leader piece is reduced to zero strength, it is removed to the discard area along with all coupled follower pieces. Any damage dice that cannot be assigned to an enemy figure are ignored.

According to another method of play, because a leader piece's hits are so powerful, they knock the opponent back. The more damage done, the further the "knock back." Damage points are not subtracted from the pod's strength until after it has finished its knock back movement. Then, if any piece is reduced to zero strength, it is removed to the discard area. For each point of damage assigned to an enemy pod, that pod is knocked back one space (the pod does not have to pay any energy points for breaking away). It moves in a straight line away from the face of the pod it was touching. If it happened to be touching more than one side of the attacking pod when hit, the attacker chooses in which direction knock back occurs.

Figure 9:
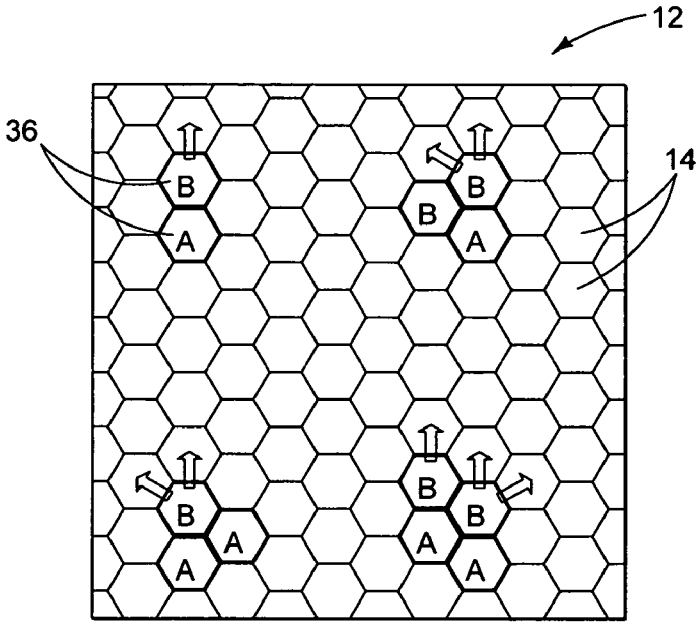
FIG. 9 is an illustration of the concept of "knock back."

Four examples of knock backs are shown in FIG. 9. As shown, "A" is the attacking pod in each example. Depending on the arrangement of pods, knock back of pod "B" could occur in the indicated directions.

Figure 10:
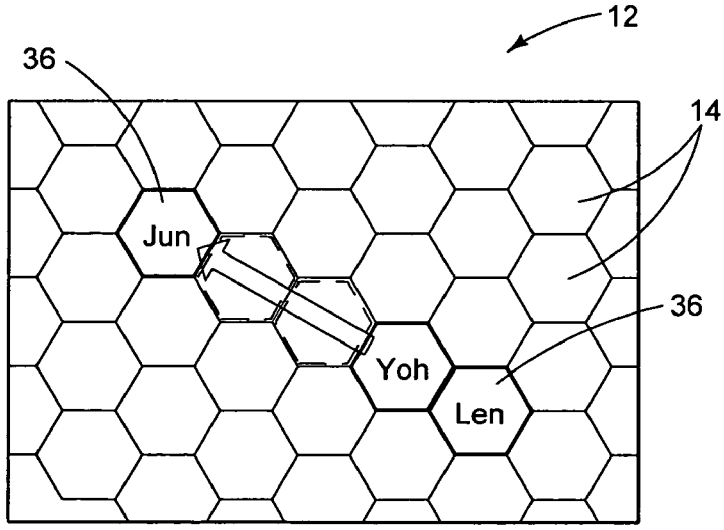
FIG. 10 is a further illustration of the concept of "knock back."

If a pod cannot complete its knock back move for any reason (such as running into another pod or reaching the edge of the board spaces), it may be assessed an alternative penalty, such as taking an additional point of damage. An example of this is shown in FIG. 10. As shown, the Len playing piece attacks Yoh and does three points of damage. Before subtracting the three damage points from his strength, Yoh must move three spaces in a straight line away from the side of Len. But the Jun playing piece blocks Yoh's path: Yoh can only move two spaces before coming in contact with Jun. Since Yoh may only move back two spaces, he suffers an additional point of damage, bringing his total damage up to four points.

According to one method of playing the game, ranged attacks do not cause knock back.

Once the combat phase is complete, players may begin again with the strategy phase.

According to one method of playing the game, the first player to eliminate all opposing leader pieces wins the game.

As previously described, in some versions of the game, some of the playing pieces may have special abilities 68. Special abilities may be represented by indicia on the corresponding playing piece. For example, a number next to a symbol may represent an energy point cost for invoking a special ability. The playing piece, or another piece in the same pod, may pay the energy points to activate that ability. If an ability does not have a number next to it, there is no cost to use it.

A playing piece may activate each of its abilities once per turn. If multiple pieces in a pod have the same ability, that pod may only use the ability once per turn. If both players wish to play special abilities at the same time, the attacker plays all of his first. A list of exemplary special abilities follows.

A special ability "fast" may allow a playing piece or pod to double its normal move. Fast may be activated before the pod moves.

A special ability "fast strike" may allow a playing piece or pod to make an attack before it moves using its full number of attack dice and still make a regular attack during the combat phase. Breaking away rules may still apply. Fast strike may be activated before the pod moves.

A special ability "snare" may allow a player controlling a pod bearing the snare symbol to choose one enemy pod on the board. The chosen pod may not move, but may still fight, in its next turn. The chosen pod may be marked with a penny or other suitable token as a reminder. Snare may be activated during the action phase.

A special ability "stealth" may allow a pod to break away and move through enemy strike zones and spaces occupied by enemy pods without penalty. Stealth may be activated before the pod moves.

A special ability "task master" may increase a leader piece's moves by one for each playing piece coupled to a leader piece bearing a task master symbol. A double base piece may only add one move. Task master may be activated before the pod moves.

A special ability "barrage" may be assigned to an entire pod. When making a ranged attack, a pod bearing this symbol does not declare a target. The pod gets double its shots and may assign damage dice to any number of enemy pods within range. Barrage may be activated before the pod shoots.

A special ability "crack shot" may allow a pod to shoot before or after it moves. Crack shot may be activated before the pod takes an action.

A special ability "deadly shot" may allow a pod to roll two damage dice for each hit rolled. Deadly shot may be activated before the damage dice are rolled for that pod's shots.

A special ability "perfect aim" may allow a pod to double its range for a turn. Perfect aim may be activated before the pod shoots.

A special ability "friendship" may allow all of the pods in base contact with a pod bearing the friendship symbol to receive an extra point on attacks until the end of the turn. Friendship must be activated at the beginning of the combat phase.

A special ability "henchmen" may allow a pod to roll a die to determine a number of extra attacks in which the pod may engage. Henchmen may be activated before the pod attacks.

A special ability "heroism" may allow a pod to increase its attack value by a given amount, such as one, for each enemy pod in its strike zone. Heroism may be activated when the pod attacks.

A special ability "surprise attack" may allow a pod to count a roll of two as a glancing blow as well as a roll of one. Surprise attack may be activated when the pod attacks.

A special ability "aggression" may allow a pod to re-roll any number of the damage dice once. The results of the second roll must be used. Aggression may be activated after the damage roll.

A special ability "deflection" may allow a pod to block, i.e., take no damage from the first damage die assigned to the pod. Deflection may be activated after the damage die is assigned to the pod.

A special ability "battle awareness" may allow a pod to roll the combat and damage rolls first, instead of choosing one enemy to attack. The damage dice may then be assigned to any enemy pod in base contact with the attacking pod, as long as the damage roll is equal to or greater than the enemy pod's toughness. Battle awareness may be activated before the pod attacks.

A special ability "focused attack" may allow a pod to deal two points of damage instead of one point with critical hits that were converted to a roll of six and then assigned to enemies in the pod's strike zone. Focused attack may be activated when damage dice are assigned to enemies in the pod's strike zone.

A special ability "fury" may allow a pod to convert all of the pod's damage dice to six (automatic hits). Fury may be activated before making the combat roll.

A special ability "dread" may allow pods in base contact with a pod to have their energy point costs for abilities, glancing blows, and critical hits increased by one. Dread may be activated whenever an enemy in base contact with a pod bearing the dread symbol spends energy points.

A special ability "fearsome" may require enemy pods to spend one energy or strength point to move into base contact with a pod bearing the fearsome symbol.

A special ability "initiative" may allow a pod bearing the initiative symbol to add one to the strategy roll. Initiative may be activated after the strategy roll.

A special ability "invigorate" may allow a pod to select one friendly leader piece that is in base contact with the pod. A die may be rolled for each energy point the leader piece has spent. For each four or greater that is rolled, the leader piece recovers one energy point. A leader piece may not use this ability on itself. Invigorate is activated during the strategy phase.

A special ability "healing" may allow a pod to select one friendly leader piece that is in the pod or in base contact with the pod and roll a die. The selected leader piece recovers strength equal to the number rolled. It may be healed above its starting strength. A leader piece may not heal itself. Healing may be activated during the strategy phase.

A special ability "regeneration" may allow a pod to roll a die for each strength the playing piece has lost. For each four or greater rolled, this playing piece recovers one strength point. Regeneration is activated during the strategy phase.

A special ability "spirit control" may allow a pod to roll a die. A pod that rolls a five or better may return a defeated spirit from the discard area to the summon area. The returned spirit returns at strength of one and energy of one. Spirit control is activated in place of the summon roll and counts as the summon for that turn. Spirit control may only be applied to spirits.

A special ability "spirit strength" may allow a playing piece (instead of the entire pod) to remain in the game until the end of the next turn. A bead or coin or other similar marker may be placed next to the playing piece as a reminder. Spirit strength may be activated when the playing piece is reduced to zero strength.

A special ability "steadfast" may restrict a pod from suffering knock back movement or knock back damage during a turn when the steadfast ability is activated. Steadfast may be activated after damage dice are assigned to the pod.

A special ability "steal essence" may give a pod bearing the steal essence symbol gets one ability from any enemy playing piece on the board, without paying that ability's cost. Steal essence may be activated whenever the copied ability may be activated.

A special ability "ward" may be activated after an enemy activates a special ability in a pod that is in base contact with the pod bearing the ward symbol. The effects of the activated special ability are cancelled. Ward may not be used to cancel an enemy's use of the ward ability.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A method of playing a combat-style game for a plurality of players, comprising:

selecting a set of playing pieces;

placing a first playing piece having a plurality of first indicia on a game board;

placing at least a second playing piece having a plurality of second indicia on the game board;

coupling at least the second playing piece to the first playing piece to form a third playing piece;

determining a set of characteristics for the third playing piece, wherein each characteristic has a value corresponding to the result of a mathematical function applied to at least one of the first and second indicia; and moving the third playing piece as a unit along the game board.

2. The method of claim 1, wherein at least one characteristic of the third playing piece enables the third playing piece to perform a task that was not allowed by the first or second playing pieces individually.

3. The method of claim 1, further comprising placing a fourth playing piece on the game board, and attacking the third playing piece with the fourth playing piece, wherein a successful attack alters at least one characteristic of the third playing piece.

4. The method of claim 3, wherein the at least one altered characteristic is indicated on at least one of the first and second playing pieces.

5. The method of claim 3, wherein at least one of the first and second playing pieces is uncoupled from the third playing piece and removed from game play when the at least one characteristic of the third playing piece has been altered by a predetermined amount.

6. The method of claim 3, further comprising unsuccessfully attacking one playing piece by another playing piece, and converting the unsuccessful attack to a successful attack by altering at least one characteristic of the one playing piece.

7. The method of claim 1, wherein the step of selecting a set of playing pieces includes selecting a set of playing pieces, each having at least a playing characteristic with a predetermined value, until the total of the values of the playing characteristics of the selected playing pieces reaches a predetermined amount.

8. The method of claim 7, wherein each selected playing piece has at least one playing characteristic that differs from the playing characteristics of the other selected playing pieces.

9. The method of claim 1, further comprising taking turns of playing the selected playing pieces, during a turn, summoning an additional playing piece onto the game board and repeating summoning of additional playing pieces until all playing pieces are in game play.

10. The method of claim 1, further comprising generating a random indicia, comparing the random indicia to indicia associated with a fourth playing piece not yet placed on the game board, and placing the fourth playing piece on the game board if the random indicia relates in a predetermined way to indicia associated with the fourth playing piece.

11. The method of claim 1, wherein at least one of the characteristics of the third playing piece has a value at least as large as the sum of a corresponding first indicia and a corresponding second indicia.

12. The method of claim 1, further comprising determining a set of characteristics for each playing piece, wherein each playing piece includes a figure and a base, the orientation of the figure with respect to the base providing a plurality of available characteristics from which the set is determined.

13. A game apparatus comprising:

a game board having a plurality of board spaces; and a plurality of playing pieces adapted to be positioned on the board spaces, the plurality of playing pieces including at least;

a first playing piece having a first base and a first set of characteristics denoted by indicia;

a second playing piece having a second base and a second set of characteristics denoted by indicia; and a coupling mechanism adapted to couple removably the first base and the second base, thereby forming a unitary third playing piece, wherein at least one indicia of the first base and a corresponding indicia of the second base are adapted to be altered through a range of indicia, and coupling of the first and second bases reduces the sum of the indicia of the first and second bases so that a third set of characteristics for the third playing piece is formed.

* * * * *